US011231048B2

(12) United States Patent
Zhang

(10) Patent No.: US 11,231,048 B2
(45) Date of Patent: Jan. 25, 2022

(54) BLADE ADJUSTMENT MECHANISM AND AIR CIRCULATOR

(71) Applicants: GD MIDEA ENVIRONMENT APPLIANCES MFG CO., LTD., Zhongshan (CN); MIDEA GROUP CO., LTD., Foshan (CN)

(72) Inventor: Huanming Zhang, Zhongshan (CN)

( * ) Notice: Subject to any disclaimer, the term of this patent is extended or adjusted under 35 U.S.C. 154(b) by 10 days.

(21) Appl. No.: 17/042,889

(22) PCT Filed: Dec. 14, 2018

(86) PCT No.: PCT/CN2018/121117
§ 371 (c)(1),
(2) Date: Sep. 28, 2020

(87) PCT Pub. No.: WO2019/218658
PCT Pub. Date: Nov. 21, 2019

(65) Prior Publication Data

US 2021/0095695 A1 Apr. 1, 2021

(30) Foreign Application Priority Data

May 16, 2018 (CN) ..... 201810478431.7
May 16, 2018 (CN) ..... 201820742118.5

(51) Int. Cl.
*F04D 29/46* (2006.01)
*F04D 29/28* (2006.01)

(52) U.S. Cl.
CPC ..... *F04D 29/462* (2013.01); *F04D 29/281* (2013.01)

(58) Field of Classification Search
CPC . F04D 29/462; F05D 2240/52; F05D 2250/90
See application file for complete search history.

(56) References Cited

U.S. PATENT DOCUMENTS 7,529,088 B2 * 5/2009 Chiu ..... F04D 29/161 361/695
8,408,981 B2 * 4/2013 Su ..... F04D 27/002 454/358

(Continued)

FOREIGN PATENT DOCUMENTS

CN 201126218 Y 10/2008
CN 103528175 A 1/2014

(Continued)

OTHER PUBLICATIONS

European Search Report of EP App No. 18918600.0.

(Continued)

*Primary Examiner* — Ninh H. Nguyen
(74) *Attorney, Agent, or Firm* — Kilpatrick Townsend & Stockton, LLP

(57) ABSTRACT

Disclosed is a blade adjustment mechanism and an air circulator. The air circulator includes a housing defining an air outlet. The blade adjustment mechanism includes: a fixing bracket fixedly connected with the housing and defining a sliding space; at least two adjustment members, a part of each of the at least two adjustment members is accommodated in the sliding space and slidably connected with the fixing bracket, each of the at least two adjustment members defining a first adjustment slot at an end adjacent to the air outlet; at least two first wind deflectors, a part of one of the at least two first wind deflectors being configured to extend into the air outlet and being rotationally connected with the fixing bracket, a part of one of the at least two first wind deflectors facing away from the air outlet being movably accommodated in the first adjustment slot.

20 Claims, 7 Drawing Sheets

(56) References Cited

U.S. PATENT DOCUMENTS

| | | | | |
|---|---|---|---|---|
| 10,697,656 | B2 * | 6/2020 | Ediger | F24F 1/0025 |
| 2012/0328430 | A1 * | 12/2012 | Ediger | F04D 29/4206 415/211.2 |
| 2017/0363306 | A1 | 12/2017 | Cur et al. | |

FOREIGN PATENT DOCUMENTS

| | | | |
|---|---|---|---|
| CN | 103307726 | B | 1/2016 |
| CN | 107327949 | A | 11/2017 |
| CN | 108361854 | A | 8/2018 |
| GB | 2351145 | A | 12/2000 |
| JP | S6186529 | A | 5/1986 |
| JP | H07103560 | A | 4/1995 |
| JP | 2005003289 | A | 1/2005 |
| KR | 20120001882 | U | 3/2012 |

OTHER PUBLICATIONS

International Search Report of PCT/CN2018/121117.
Written Opinion of the International Searching Authority for PCT/CN2018/121117.

* cited by examiner

BLADE ADJUSTMENT MECHANISM AND AIR CIRCULATOR

CROSS-REFERENCES TO RELATED APPLICATIONS

The present disclosure is a national phase application of International Application No. PCT/CN2018/121117, filed on Dec. 14, 2018, which claims the benefit of Chinese Patent applications with No. 201810478431.7 and 201820742118.5, filed in Chinese Patent Office on May 16, 2018, the entirety of which is hereby incorporated herein by reference.

FIELD

This application relates to the field of air circulators, in particular to a blade adjustment mechanism and an air circulator having the blade adjustment mechanism

BACKGROUND

The housing of an air circulator generally defines an air inlet and an air outlet. A cross-flow fan is mounted inside the housing. The cross-flow fan draws air from the air inlet, and the cross-flow fan rotates to create wind pressure and generate centrifugal wind force, then the wind force is conducted through the internal wind guide wall, and then blows out from the air outlet. Since the cross-flow wind wheel is generally cylindrical, a three-dimensional airflow wall is obtained by using the air circulator. Guide blades and the air outlet of the existing air circulator are fixed to each other, and the whole machine or air duct can only be moved within a certain angle through the shaking head mechanism, but the wind at the air outlet cannot be blown in a concentrated manner or divergingly, and the user experience is poor.

SUMMARY

The main object of this application is to provide a blade adjustment mechanism, which aims to enable the air outlet to have the functions of centralized and divergent blowing, and improve user experience.

In order to achieve the above object, the blade adjustment mechanism provided in this application is applied to an air circulator including a housing defining an air outlet. The blade adjustment mechanism includes:

a fixing bracket, fixedly connected with the housing and defining a sliding space;

at least two adjustment members, a part of each of the at least two adjustment members being accommodated in the sliding space and being slidably connected with the fixing bracket, each of the at least two adjustment members defining a first adjustment slot at an end adjacent to the air outlet; and at least two first wind deflectors, a part of one of the at least two first wind deflectors being configured to extend into the air outlet and being rotationally connected with the fixing bracket, a part of one of the at least two first wind deflectors facing away from the air outlet being movably accommodated in the first adjustment slot;

where the at least two adjustment members are driven to move away from or move closer to each other, the first adjustment slot being configured to drive one of the at least two first wind deflectors to rotate to make the air outlet blow divergingly or in a concentrated manner.

In one embodiment, each of the at least two first wind deflectors includes:

a blade, accommodated in the air outlet; and a rotation and connection adjustment member, one end of the rotation and connection adjustment member being fixedly connected with the blade, the other end of the rotation and connection adjustment member being rotationally connected with the fixing bracket, a part of the rotation and connection adjustment member being movably accommodated in the first adjustment slot.

In one embodiment, one of an end of the rotation and connection adjustment member facing away from the blade and the fixing bracket defines an insertion hole, the other of the end of the rotation and connection adjustment member facing away from the blade and the fixing bracket including an insertion post, the insertion post being inserted into the insertion hole to rotationally connect the rotation and connection adjustment member and the fixing bracket.

In one embodiment, the rotation and connection adjustment member includes a first rotation and connection shaft extending from one end of the blade and a first adjustment rod extending from an outer side surface of the first rotation and connection shaft, the insertion hole being defined on the first rotation and connection shaft and extending along an axial direction of the first rotation and connection shaft, a portion of the first adjustment rod facing away from the first rotation and connection shaft being accommodated in the first adjustment slot.

In one embodiment, the first adjustment rod includes a first rod and a second rotation and connection shaft, one end of the first rod being fixedly connected with the outer surface of the first rotation and connection shaft, the other end of the first rod being fixedly connected with an outer surface of the second rotation and connection shaft, the second rotation and connection shaft being accommodated in the first adjustment slot, the outer surface of the second rotation and connection shaft being abutted against a slot wall of the first adjustment slot.

In one embodiment, one of the at least two adjustment members further defines at least one second adjustment slot at a side adjacent to the at least two first wind deflectors;

the blade adjustment mechanism further includes at least one second wind deflector located between two of the at least two first wind deflectors and rotationally connected with the fixing bracket;

a part of the at least one second wind deflector is configured to extend into the air outlet, a part of one of the at least one second wind deflector facing away from the air outlet being movably accommodated in one of the at least one second adjustment slot, the at least two adjustment members being driven to move away from or move closer to each other, the at least one second adjustment slot being configured to drive the at least one second wind deflector to rotate to make the air outlet blow divergingly or in a concentrated manner.

In one embodiment, an extension length of the first adjustment slot is smaller than an extension length of the second adjustment slot; and a length of the part of one of the at least two first wind deflectors extending into the first adjustment slot is smaller than a length of the part of the at least one second wind deflector extending into the second adjustment slot.

In one embodiment, the fixing bracket includes a main frame, a connection part and a mounting part, the connection part being configured to connect the mounting part and the main frame, the insertion post being provided on the mounting part, the main frame body defining the sliding space.

In one embodiment, one of an inner wall of the sliding space and one of the at least two the adjustment members defines a guide slot, the other of the inner wall of the sliding space and the one of the at least two adjustment members including a projection adaptively accommodated in the guide slot, the projection being configured to slide in the guide slot and limit a sliding direction of the one of the at least two adjustment members relative to the fixing bracket.

In one embodiment, the connection part further includes a protrusion part at an outer side, the protrusion part defining a mounting hole, the blade adjustment mechanism further including a connection piece, the connection piece being configured to pass through the mounting hole to fixedly connect the fixing bracket and the housing.

In one embodiment, one of the at least two adjustment members includes a main body plate and a plurality of first side plates extending from a surface of the main body plate and a plurality of second side plates extending from the surface of the main body plate, the main body plate, a part of each of the plurality of first side plates and a part of each of the plurality of second side plates being accommodated in the sliding space, each two of the plurality of first side plates defining one first adjustment slot, each two of the plurality of second side plates defining one second adjustment slot.

In one embodiment, one of the at least two adjustment members further includes a reinforcement plate connecting two side plates of one first adjustment slot;

and/or, the reinforcement plate is configured to connect one of the plurality of first side plates and one of the plurality of second side plates.

In one embodiment, the main body plate further includes an operation part on a surface facing away from the plurality of first side plates, and the operation part is configured to extend out of the sliding space.

In one embodiment, the fixing bracket and the housing are integrally formed;

or, the fixing bracket and the housing are detachably provided.

This application further provides an air circulator, including a housing, a cross-flow wind wheel and a blade adjustment mechanism located above the cross-flow wind wheel, the housing defining an air outlet, the cross-flow wind wheel being fixedly connected with the housing, and the blade adjustment mechanism includes:

a fixing bracket, fixedly connected with the housing and defining a sliding space;

at least two adjustment members, a part of each of the at least two adjustment members being accommodated in the sliding space and being slidably connected with the fixing bracket, each of the at least two adjustment members defining a first adjustment slot at an end adjacent to the air outlet; and at least two first wind deflectors, a part of one of the at least two first wind deflectors being configured to extend into the air outlet and being rotationally connected with the fixing bracket, a part of one of the at least two first wind deflectors facing away from the air outlet being movably accommodated in the first adjustment slot;

where the at least two adjustment members are driven to move away from or move closer to each other, the first adjustment slot being configured to drive one of the at least two first wind deflectors to rotate to make the air outlet blow divergingly or in a concentrated manner.

Embodiments of this application, a housing defines an air outlet, and a fixing bracket, first wind deflectors and adjustment members are provided on the housing. The first wind deflectors are rotationally connected with the fixing bracket, and a part of one first wind deflector facing away from the air outlet is movably accommodated in the first adjustment slot. When the air outlet is required to blow in a concentrated manner, the adjustment members are driven to move away from each other in the sliding space, so that a slot wall on one side of the first adjustment slot may push the part of the first wind deflector accommodated in the first adjustment slot to move, and a slot wall on the other side of the first adjustment slot may limit the part of the first wind deflector accommodated in the first adjustment slot, so that the first wind deflector may rotate around the fixing bracket, so that the parts of the first wind deflectors that extend into the air outlet may be gathered relative to the air outlet, so that the air outlet may blow in a concentrated manner. When the air outlet is required to blow divergingly, the adjustment members are driven to move closer to each other in the sliding space, so that a slot wall on one side of the first adjustment slot may push the part of the first wind deflector accommodated in the first adjustment slot to move, and a slot wall on the other side of the first adjustment slot may limit the part of the first wind deflector accommodated in the first adjustment slot, so that the first wind deflector may rotate around the fixing bracket, so that the parts of the first wind deflectors that extend into the air outlet may be opened relative to the air outlet, so that the air outlet may blow divergingly. Embodiments of this application describe the air outlet may have the functions of centralized blowing and divergent blowing, improving the user experience.

BRIEF DESCRIPTION OF THE DRAWINGS

Embodiments of this application will be briefly introduced in the drawings.

DESCRIPTION OF REFERENCE NUMERALS

TABLE 1

Figure 1:
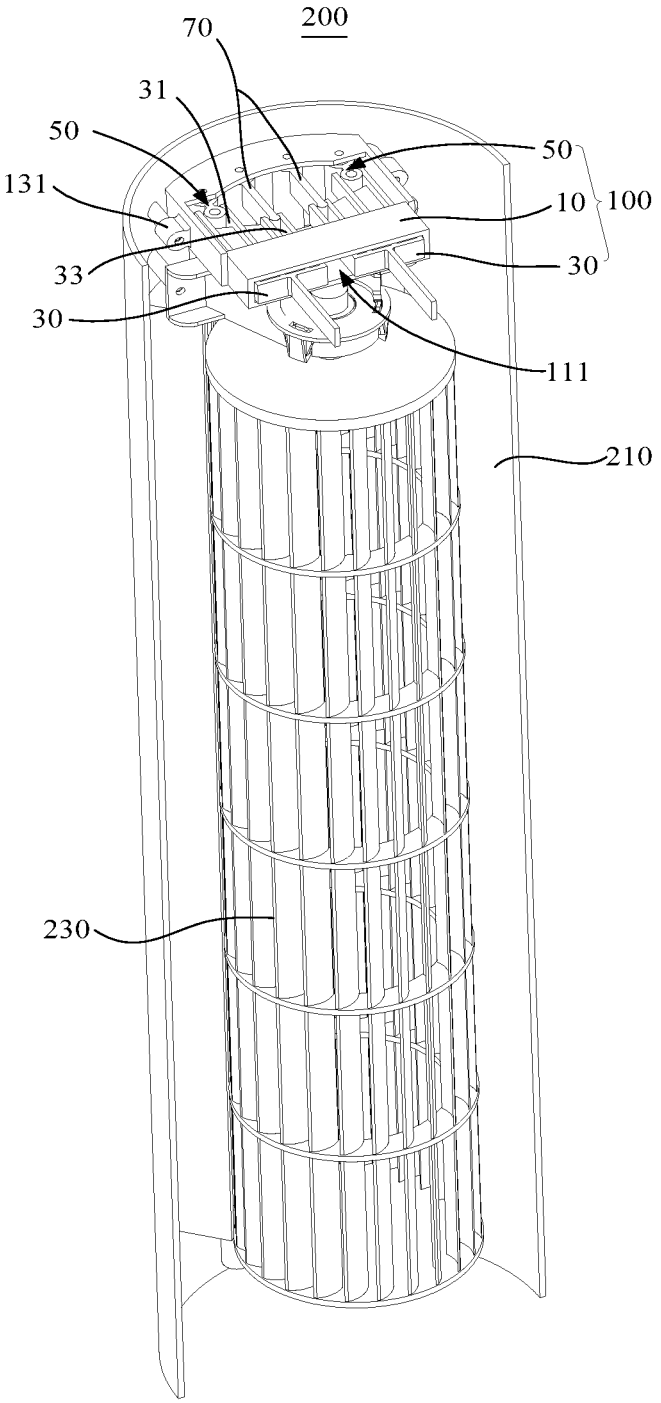
FIG. 1 is a schematic structural diagram of an air circulator in a centralized blowing state according to an embodiment of this application.
Figure 2:
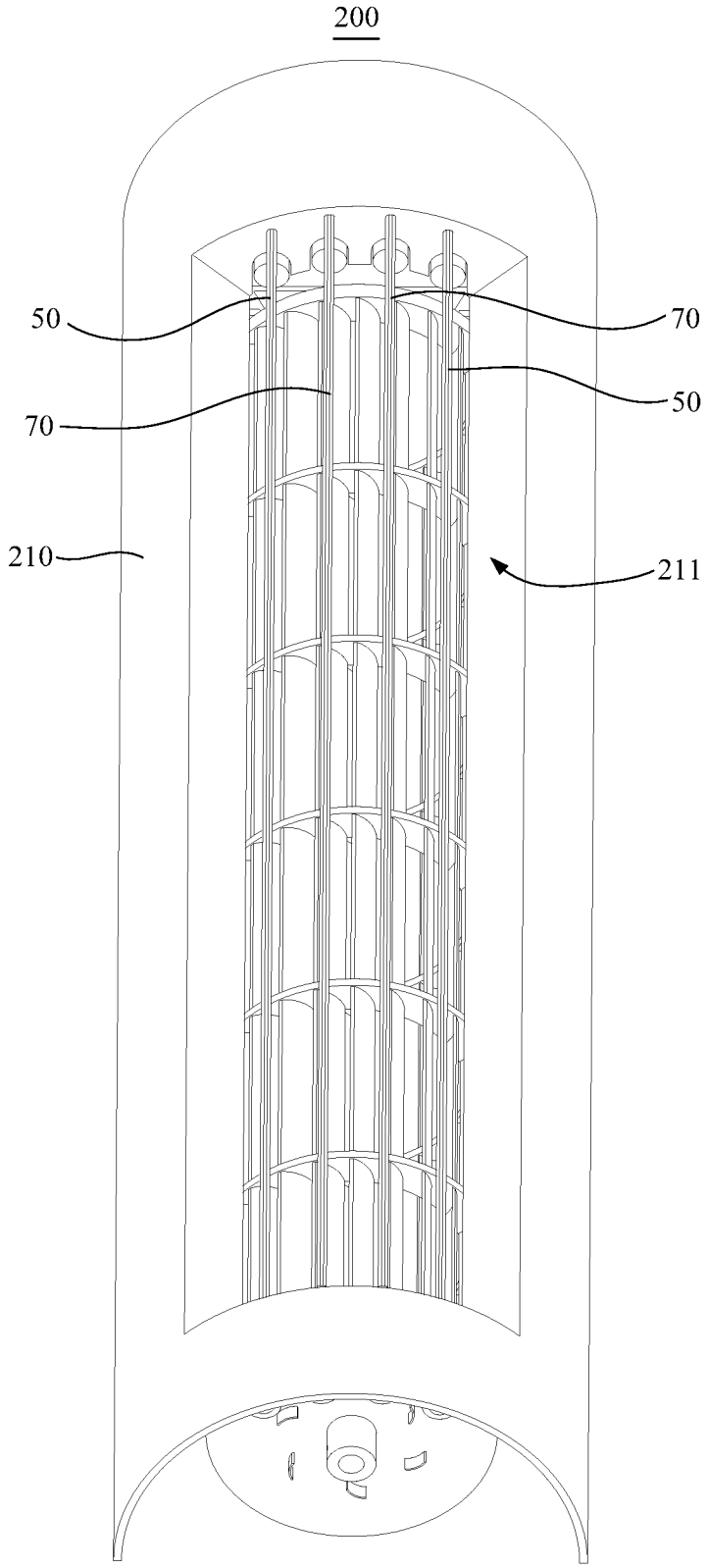
FIG. 2 is a schematic structural diagram from another perspective of the air circulator in the centralized blowing state according to an embodiment of this application.

| No. | Name | No. | Name |
|---|---|---|---|
| 100 | Blade adjustment mechanism | 50 | First wind deflector |
| 10 | Fixing bracket | 51 | Blade |
| 11 | Main frame | 53 | Rotation and |

TABLE 1-continued

| No. | Name | No. | Name |
|---|---|---|---|
| | | | connection adjustment member |
| 111 | Sliding space | 531 | First rotation and connection shaft |
| 13 | Connection part | 5311 | Insertion hole |
| 131 | Insertion post | 533 | First adjustment rod |
| 1311 | Mounting hole | 5331 | First rod |
| 15 | Mounting part | 5333 | Second rotation and connection shaft |
| 153 | Protrusion part | 70 | Second wind deflector |
| 30 | Adjustment member | 71 | Second adjustment rod |
| 31 | First adjustment slot | 711 | Second rod |
| 33 | Second adjustment slot | 713 | Third rotation and connection shaft |
| 35 | Main body plate | 200 | Air circulator |
| 351 | Operation part | 210 | Housing |
| 37 | First side plate | 211 | Air outlet |
| 38 | Reinforcement plate | 230 | Cross-flow wind wheel |
| 39 | Second side plate | | |

DETAILED DESCRIPTION OF THE DISCLOSURE

The technical solutions in the embodiments of this application will be described clearly and completely in conjunction with the drawings in the embodiments of this application. In one embodiment, the described embodiments are only a part of the embodiments of this application, but not all the embodiments.

It should be noted that all directional indicators (such as up, down, left, right, front, back . . . ) in the embodiments of this application are only used to explain the relative positional relationship, movement conditions, etc. among the components in a specific posture (as shown in the drawings), if the specific posture changes, the directional indicator also changes accordingly.

In addition, the descriptions related to "first", "second", etc. in this application are for descriptive purposes only, and cannot be understood as indicating or implying their relative importance or implicitly indicating the number of indicated features. Thus, the features defined as "first" and "second" may include at least one of the features either explicitly or implicitly. In addition, the solutions between the various embodiments can be combined with each other.

This application provides a blade adjustment mechanism 100.

Referring to FIGS. 1 to 7, the blade adjustment mechanism 100 provided in the embodiments of this application is applied to an air circulator 200. The air circulator 200 includes a housing 210 defining an air outlet 211. The blade adjustment mechanism 100 includes:

a fixing bracket 10, fixedly connected with the housing 210 and defining a sliding space 111;

at least two adjustment members 30, a part of each of the at least two adjustment members 30 being accommodated in the sliding space 111 and being slidably connected with the fixing bracket 10, each of the at least two adjustment member 30 defining a first adjustment slot 31 at an end adjacent to the air outlet 211; and at least two first wind deflectors 50, a part of one of the at least two first wind deflectors 50 being configured to extend into the air outlet 211 and being rotationally connected with the fixing bracket 10, a part of one of the at least two first wind deflectors 50 facing away from the air outlet 211 being movably accommodated in the first adjustment slot 31;

where the at least two adjustment members 30 are driven to move away from or move closer to each other, and the first adjustment slot 31 is configured to drive one of the at least two first wind deflectors 50 to rotate to make the air outlet 211 blow divergingly or in a concentrated manner.

Embodiments of this application, a housing 210 defines an air outlet 211, and a fixing bracket 10, first wind deflectors 50 and adjustment members 30 are provided on the housing 210. The first wind deflectors 50 are rotationally connected with the fixing bracket 10, and a part of one first wind deflector 50 facing away from the air outlet 211 is movably accommodated in the first adjustment slot 31. When the air outlet 211 is required to blow in a concentrated manner, the adjustment members 30 are driven to move away from each other in the sliding space 111, so that a slot wall on one side of the first adjustment slot 31 may push the part of the first wind deflector 50 accommodated in the first adjustment slot 31 to move, and a slot wall on the other side of the first adjustment slot 31 may limit the part of the first wind deflector 50 accommodated in the first adjustment slot 31, so that the first wind deflector 50 may rotate around the fixing bracket 10, so that the parts of the first wind deflectors 50 that extend into the air outlet 211 may be gathered relative to the air outlet 211, so that the air outlet 211 may blow in a concentrated manner. When the air outlet 211 is required to blow divergingly, the adjustment members 30 are driven to move closer to each other in the sliding space 111, so that a slot wall on one side of the first adjustment slot 31 may push the part of the first wind deflector 50 accommodated in the first adjustment slot 31 to move, and a slot wall on the other side of the first adjustment slot 31 may limit the part of the first wind deflector 50 accommodated in the first adjustment slot 31, so that the first wind deflector 50 may rotate around the fixing bracket 10, so that the parts of the first wind deflectors 50 that extend into the air outlet 211 may be opened relative to the air outlet 211, so that the air outlet 211 may blow divergingly. Embodiments of this application, the air outlet 211 may have the functions of centralized blowing and divergent blowing, improving the user experience.

In an embodiment of this application, the housing 210 is substantially cylindrical, and its material may be hard plastic or light alloy, as long as the housing 210 has a certain supporting function, and an installation space can be defined inside. It can be understood that some components of the air circulator 200 are installed in the installation space. The air outlet 211 is configured to communicate the installation space of the air circulator 200 with the external space. In this embodiment, the air outlet 211 is substantially fan-shaped. It can be understood that the air outlet 211 may include opposite air inlet side and air outlet side. The airflow enters from the air inlet side, flows out from the air outlet side, and flows out of the air outlet 211. The part of the first wind deflector 50 facing away from the air outlet 211 is the part at the air inlet side. The opening angle of the air outlet 211 may be set according to actual needs, and the shape of the air outlet 211 may be set according to the air outlet requirements of the air circulator 200.

In addition, the fixing bracket 10 is installed and fixed adjacent to the air outlet 211, so that it is convenient for connecting the fixing bracket 10 and the first wind deflectors 50. It should be noted that the fixing bracket 10 may be formed integrally with the housing 210, or the fixing bracket 10 and the housing 210 may be detachably connected to each other. In one embodiment, the fixing bracket 10 and the housing 210 may be engaged by engaging members or fastened with fasteners to be fixed with each other. In one embodiment, the fixing bracket 10 and the housing 210 may also be fixed by a non-detachable connection manner. In one embodiment, fixing methods such as welding may be used, as long as they can make a better connection between the fixing bracket 10 and the housing 210.

Figure 6:
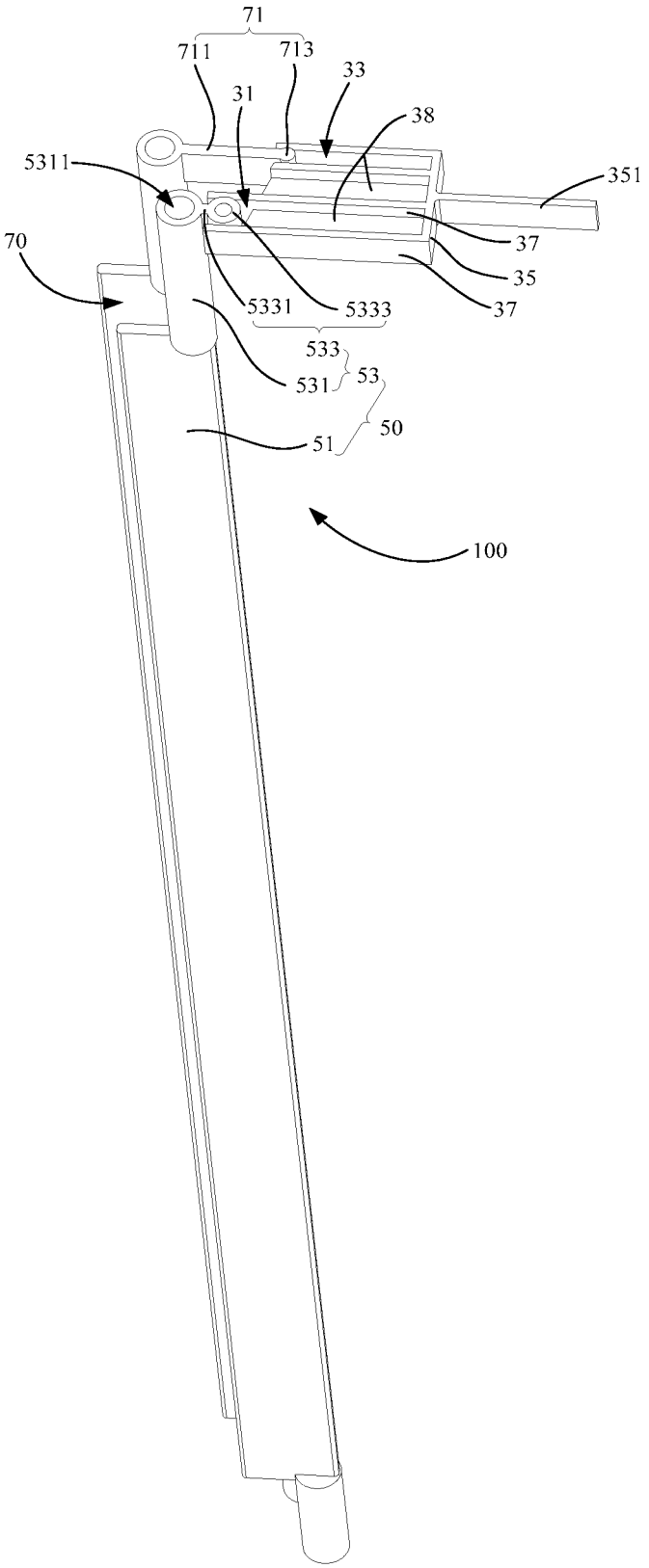
FIG. 6 is a schematic diagram of an assembly structure of a first wind deflector, a second wind deflector and an adjustment member of the blade adjustment mechanism according to an embodiment.

Referring to FIG. 6, further, each first wind deflector 50 includes:

a blade 51, accommodated in the air outlet 211; and a rotation and connection adjustment member 53, one end of the rotation and connection adjustment member 533 being fixedly connected with the blade 51, the other end of the rotation and connection adjustment member 533 being rotationally connected with the fixing bracket 10, a part of the rotation and connection adjustment member 533 being movably accommodated in the first adjustment slot 31.

In an embodiment of this application, the blades 51 are accommodated in the air outlet 211, that is, the first wind deflectors 50 mainly gather or disperse the airflow through the blades 51. It can be understood that the first wind deflector 50 may have various cross-sectional shapes, such as an aerodynamic airfoil shape, a rectangular shape, a curved shape, etc., as long as it is convenient for the wind to exit. When the first wind deflectors 50 blow in a concentrated manner, side surfaces of the blades 51 at the air inlet side may enclose an edge of the air outlet 211 toward the air inlet side, so that more air may be directed to a central opening, achieving a better concentrated blowing effect. When the first wind deflectors 50 blow divergently, side surfaces of the blades 51 at the air outlet side may block a gap between an inner side wall of the air outlet 211 and the blades 51, so that more air may be guided to the central opening, achieving higher air flow rate, to have a better effect of divergent blowing (wide-angle blowing).

The rotation and connection adjustment member 533 is configured to rotationally connect the blades 51 with the fixing bracket 10, and drive the blades 51 to rotate when it is driven by the adjustment member 30, to realize the functions of concentrated blowing and divergent blowing of the air outlet 211. The rotation and connection adjustment member 533 is provided to make the response of the blades 51 better.

Figure 5:
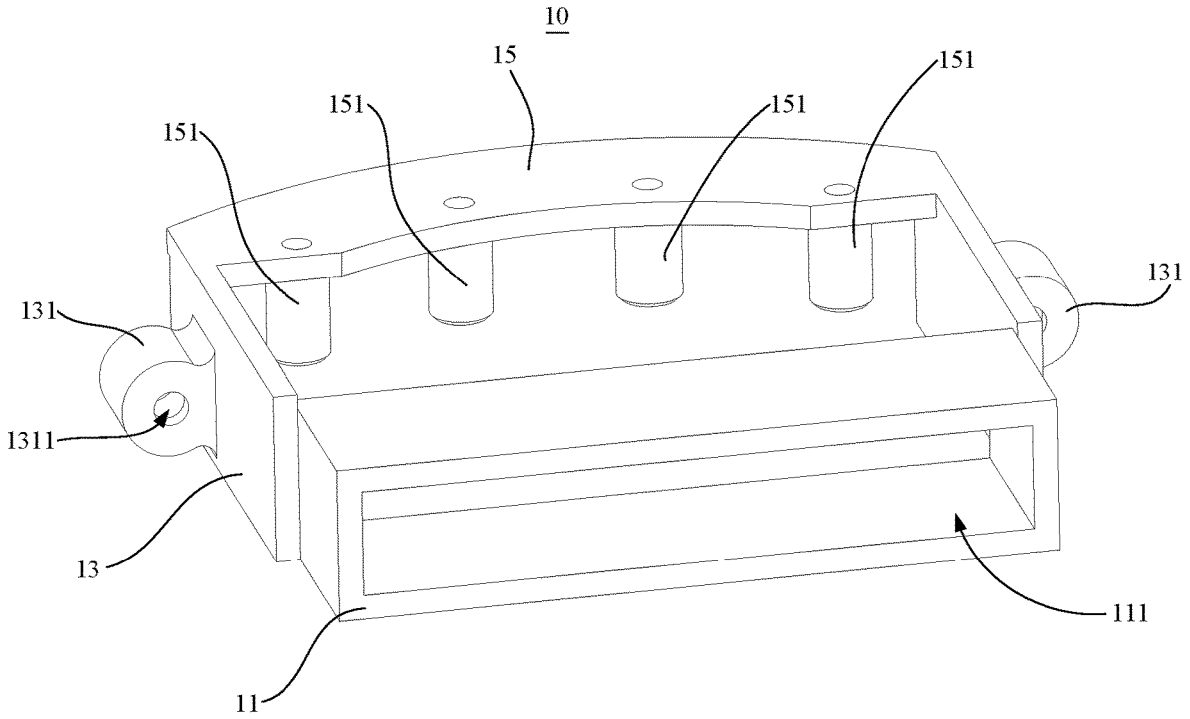
FIG. 5 is a schematic structural diagram of a fixing bracket of a blade adjustment mechanism according to an embodiment.

Referring to FIGS. 5 and 6, further, one of an end of the rotation and connection adjustment member 533 facing away from the blade 51 and the fixing bracket 10 defines an insertion hole 5311, and the other of the end of the rotation and connection adjustment member 533 facing away from the blade 51 and the fixing bracket 10 includes an insertion post 131. The insertion post 131 is inserted into the insertion hole 5311 to rotationally connect the rotation and connection adjustment member 533 and the fixing bracket 10. In this embodiment, the rotation and connection adjustment member 533 and the fixing bracket 10 are rotationally connected by means of the insertion hole 5311 and the insertion post 131, so that the blades 51 and the fixing bracket 10 are simple in structure and have a good rotation and connection function, reducing production costs. In one embodiment, a fixed pair and a rotating pair may also be provided, and the fixed pair and the rotating pair are connected through balls or bearings to achieve rotation.

Figure 3:
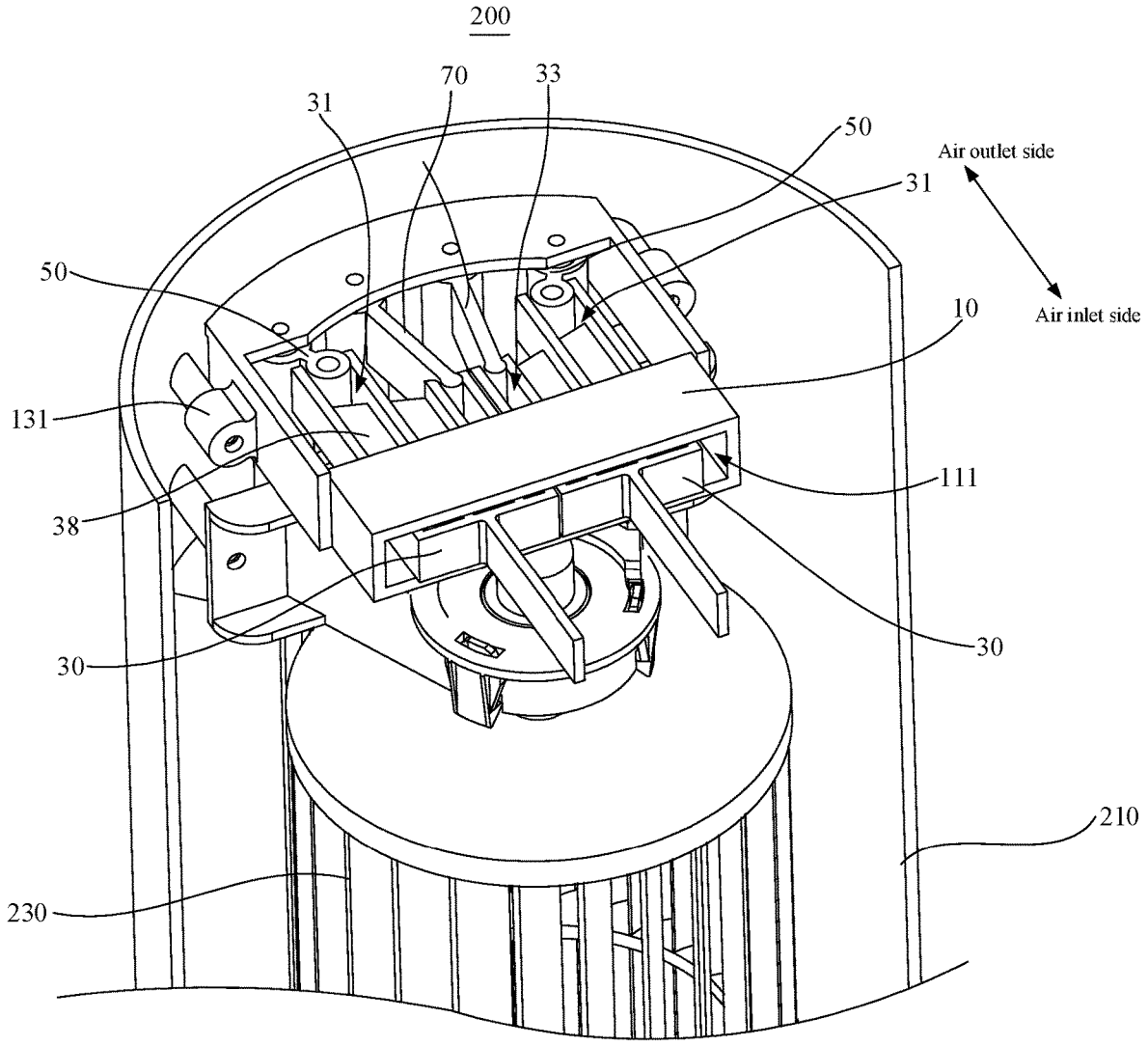
FIG. 3 is a schematic structural diagram of the air circulator in a divergent blowing state according to an embodiment of this application.
Figure 4:
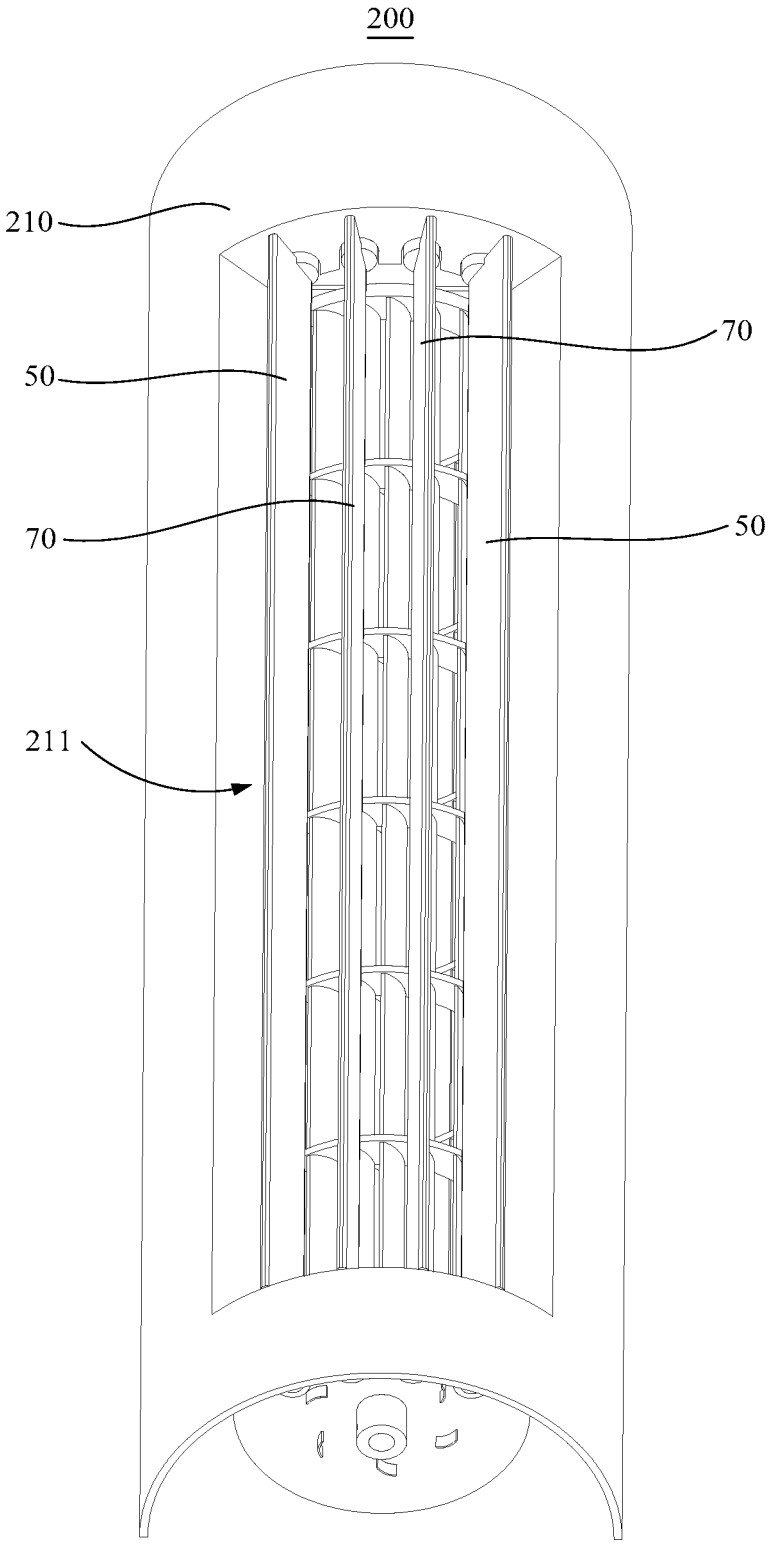
FIG. 4 is a schematic structural diagram from another perspective of the air circulator in the divergent blowing state according to an embodiment of this application.

Referring to FIGS. 3 and 6, in an embodiment of this application, the rotation and connection adjustment member 533 includes a first rotation and connection shaft 531 extending from one end of the blade 51 and a first adjustment rod extending from an outer side surface of the first rotation and connection shaft 531. The insertion hole 5311 is defined on the first rotation and connection shaft 531 and is configured to extend along an axial direction of the first rotation and connection shaft 531. A portion of the first adjustment rod facing away from the first rotation and connection shaft 531 is accommodated in the first adjustment slot 31. In this embodiment, the insertion hole 5311 is defined on the first rotation and connection shaft 531, and the insertion hole 5311 is configured to extend along the axial direction of the first rotation and connection shaft 531. This arrangement is convenient for processing and enables the connection of the rotation and connection adjustment member 533 and the fixing bracket 10 be compact, saves space, and makes the rotation connection effect of the two better. The first adjustment rod is provided to increase the rotation angle of the blades 51, so that the air outlet 211 may have a better effect of concentrated blowing or divergent blowing. And, according to the principle of distance and effort in the lever principle, it is convenient for users to use smaller force to drive the adjustment member 30, to achieve the corresponding effect of concentrated blowing or divergent blowing.

Further, the first adjustment rod includes a first rod 5331 and a second rotation and connection shaft 5333. One end of the first rod 5331 is fixedly connected with an outer surface of the first rotation and connection shaft 531, and the other end of the first rod 5331 is fixedly connected with an outer surface of the second rotation and connection shaft 5333. The second rotation and connection shaft 5333 is accommodated in the first adjustment slot 31, and the outer surface of the second rotation and connection shaft 5333 is abutted against a slot wall of the first adjustment slot 31. The first rod 5331 is provided to connect the first rotation and connection shaft 531 and the second rotation and connection shaft 5333, and extend a length of the first adjustment rod, to improve the effect of control of rotation and connection. The second rotation and connection shaft 5333 is provided so that the first adjustment rod may slide and rotate in the first adjustment slot 31, so that when the adjustment member 30 moves, the first adjustment rod may be best driven to move to achieve the best control effect. In addition, the outer side surface of the second rotation and connection shaft 5333 is abutted against the slot wall of the first adjustment slot 31 to reduce poor transmission and make it easier for the adjustment member 30 to drive the rotation and connection adjustment member 533 to move. It can be understood that a diameter of a shaft body of the second rotation and connection shaft 5333 may be set according to a width of the first adjustment slot 31, as long as it is convenient for movement.

Referring to FIGS. 1, 3, 6, and 7, in an embodiment of this application, one of the at least two adjustment members 30 further defines at least one second adjustment slot 33 at a side adjacent to the at least two first wind deflectors 50.

The blade adjustment mechanism 100 further includes at least one second wind deflector 70 located between two of the at least two first wind deflectors 50 and rotationally connected with the fixing bracket 10.

A part of the at least one second wind deflector 70 is configured to extend into the air outlet 211. A part of one of the at least one second wind deflector 70 facing away from the air outlet 211 is movably accommodated in one of the at least one second adjustment slot 33. The at least two adjustment members 30 are driven to move away from or move closer to each other, so that the at least one second adjustment slot 33 may drive the at least one second wind deflector 70 to rotate to make the air outlet 211 blow divergently or in a concentrated manner.

In this embodiment, the adjustment member 30 further defines a second adjustment slot 33 on a side surface, and the second adjustment slot 33 is defined adjacent to the first adjustment slot 31. The blade adjustment mechanism 100 further includes a second wind deflector 70, which is provided to assist the first wind deflector 50 to guide the wind. It can be understood that the second wind deflector 70 may be located on one side of a central axis of two first wind deflectors 50 or on the central axis of two first wind deflectors 50.

When the second wind deflector 70 is located on one side of the central axis of the two first wind deflectors 50, that is, the second wind deflector 70 is adjacent to one first wind deflector 50 and away from the other first wind deflector 50, a part of the second wind deflector 70 facing away from the air outlet 211 (that is, a part at the air inlet side of the air outlet 211) is movably accommodated in the second adjustment slot 33 of an adjustment member 30. The aforementioned adjustment member 30 is an adjustment member 30 connected to the first wind deflector 50 adjacent to the second wind deflector 70, that is, the first wind deflector 50 and the second wind deflector 70 located on the same side of the central axis are connected to the same adjustment member 30. This arrangement makes it convenient for the second wind deflector 70 to assist guide of the wind and further improve the effect of concentrated blowing and divergent blowing of the air outlet 211.

When the second wind deflector 70 is located on the central axis of the two first wind deflectors 50, it may be arbitrarily connected with any adjustment member 30, as long as it is convenient for the adjustment member 30 to be driven to drive the second wind deflector 70 to open or gather relative to the air outlet 211.

In this embodiment, when the air outlet 211 is required to blow in a concentrated manner, the adjustment members 30 are driven to move away from each other in the sliding space 111, so that a slot wall on one side of the second adjustment slot 33 may push the part of the second wind deflector 70 accommodated in the second adjustment slot 33 to move, and a slot wall on the other side of the second adjustment slot 33 may limit the part of the second wind deflector 70 accommodated in the second adjustment slot 33, so that the second wind deflector 70 may rotate around the fixing bracket 10, so that the parts of the second wind deflectors 70 that extend into the air outlet 211 may be gathered relative to the air outlet 211, so that the air outlet 211 may blow in a concentrated manner. When the air outlet 211 is required to blow divergently, the adjustment members 30 are driven to move closer to each other in the sliding space 111, so that a slot wall on one side of the second adjustment slot 33 may push the part of the second wind deflector 70 accommodated in the second adjustment slot 33 to move, and a slot wall on the other side of the second adjustment slot 33 may limit the part of the second wind deflector 70 accommodated in the second adjustment slot 33, so that the second wind deflector 70 may rotate around the fixing bracket 10, so that the parts of the second wind deflectors 70 that extend into the air outlet 211 may be opened relative to the air outlet 211, so that the air outlet 211 may blow divergently.

It can be understood that the structure of the second wind deflector 70 is similar to that of the first wind deflector 50, and the second wind deflector 70 also has blades 51 and an rotation and connection adjustment member 533. The blades 51 are consistent with the blades 51 of the first wind deflector 50. The rotation and connection adjustment member 533 of the second wind deflector 70 includes a second adjustment rod 71, and the second adjustment rod 71 includes a second rod 711 and a third rotation and connection shaft 713. One end of the second rod 711 is connected to the blade 51 of the second wind deflector 70, and the other end of the second rod 711 is connected to an outer surface of the third rotation and connection shaft 713. Lengths and radial lengths of the second rod 711 and the third rotation and connection shaft 713 may be set according to actual needs. In this embodiment, the length of the second rod 711 is greater than the length of the first rod 5331, and the radial length of the third rotation and connection shaft 713 is less than the radial length of the second rotation and connection shaft 5333. This arrangement may achieve a better effect of concentrated blowing and divergent blowing of the air outlet 211 adjusted by the first wind deflector 50 and the second wind deflector together better.

In an embodiment of this application, an extension length of the first adjustment slot 31 is smaller than an extension length of the second adjustment slot 33.

And, a length of the part of one of the at least two first wind deflectors 50 extending into the first adjustment slot 31 is smaller than a length of the part of the at least one second wind deflector 70 extending into the second adjustment slot 33.

It should be noted that an opening angle of the first wind deflector 50 determines an angle of divergent blowing of the air outlet 211. The length of the first adjustment slot 31 is set to be shorter than the length of the second adjustment slot 33, so that the rotation angle of the first wind deflector 50 may be greater than the rotation angle of the second wind deflector 70 when the adjustment member 30 is moved, to achieve a better effect of divergent blowing and concentrated blowing. And, the length of the part of the first wind deflector 50 extending into the first adjustment slot 31 is less than the length of the part of the second wind deflector 70 extending into the second adjustment slot 33. Due to the principle of lever movement, under the same displacement, the lever on the other side may have a larger displacement if the length of the lever on one side is shorter, further increasing the rotation angle range of the first wind deflector 50.

It can be understood that, in an embodiment of this application, multiple of the second wind deflectors 70 may be provided. In order to make the first wind deflectors 50 and the second wind deflectors 70 have better blowing effects, rotation angles of the second wind deflectors 70 on the same side of the central axis should be consistent, so that the air flowing out of the air outlet 211 will not interfere with each other, improving the air outlet effect.

Referring to FIG. 5, in an embodiment of this application, the fixing bracket 10 includes a main frame 11, a connection part 13 and a mounting part 15. The connection part 13 is configured to connect the mounting part 15 and the main frame 11. The insertion post 131 is provided on the mounting part 15. The main frame body 11 defines the sliding space 111. The main frame body 11 is generally arranged as a rectangular frame. In this embodiment, a movement direction of the adjustment member 30 is a long side direction of the main frame body 11. This arrangement may make the movement range of the adjustment member 30 larger, so that the rotation angles of the first wind deflector 50 and the second wind deflector 70 are larger, which facilitates the air outlet 211 to achieve the effects of concentrated blowing and divergent blowing. And, the insertion post 131 is provided on a side surface of the mounting part 15 facing the first wind deflector 50, and the insertion post 131 is provided on the fixing bracket 10 to facilitate processing and molding. In one embodiment, the fixing bracket 10 may be produced by molding.

In an embodiment of this application, one of an inner wall of the sliding space 111 and one of the at least two adjustment members 30 defines a guide slot, and the other of the inner wall of the sliding space 111 and the one of the at least two adjustment members 30 includes a projection adaptively accommodated in the guide slot. The projection is configured to slide in the guide slot and limit a sliding direction of the one of the at least two adjustment members 30 relative to the fixing bracket 10. The movement of the adjustment member 30 may be better limited in the sliding space 111 through the guide slot and the projection, so that the first wind deflector 50 and the second wind deflector 70 may be better driven to rotate. In one embodiment, a limit post may also be provided on an outer edge of the main frame body 11 to limit the moving direction of the adjustment member 30 to the sliding space 111. Or, the adjustment member 30 and the fixing bracket 10 may be fixed through a sliding rail or a rack, as long as it is convenient to guide the adjustment member 30.

Referring to FIGS. 1, 3, and 5, further, the connection part 13 further includes a protrusion part 153 at an outer side, and the protrusion part 153 defines a mounting hole 1311. The blade adjustment mechanism 100 further includes a connection piece, and the connection piece is configured to pass through the mounting hole 1311 to fixedly connect the fixing bracket 10 and the housing 210. In this embodiment, the fixing bracket 10 and the housing 210 may be connected in a detachable manner. It can be understood that the housing 210 defines a mounting hole 1311 that also fits the connection piece. In one embodiment, the connection piece may be a screw connection piece, the mounting hole 1311 may be a screw hole, and the fixing bracket 10 and the housing 210 may be fixed by a screw connection. This arrangement is convenient for installation and may better provide support for the first wind deflectors 50 and the second wind deflectors 70, which is easy to use.

Figure 7:
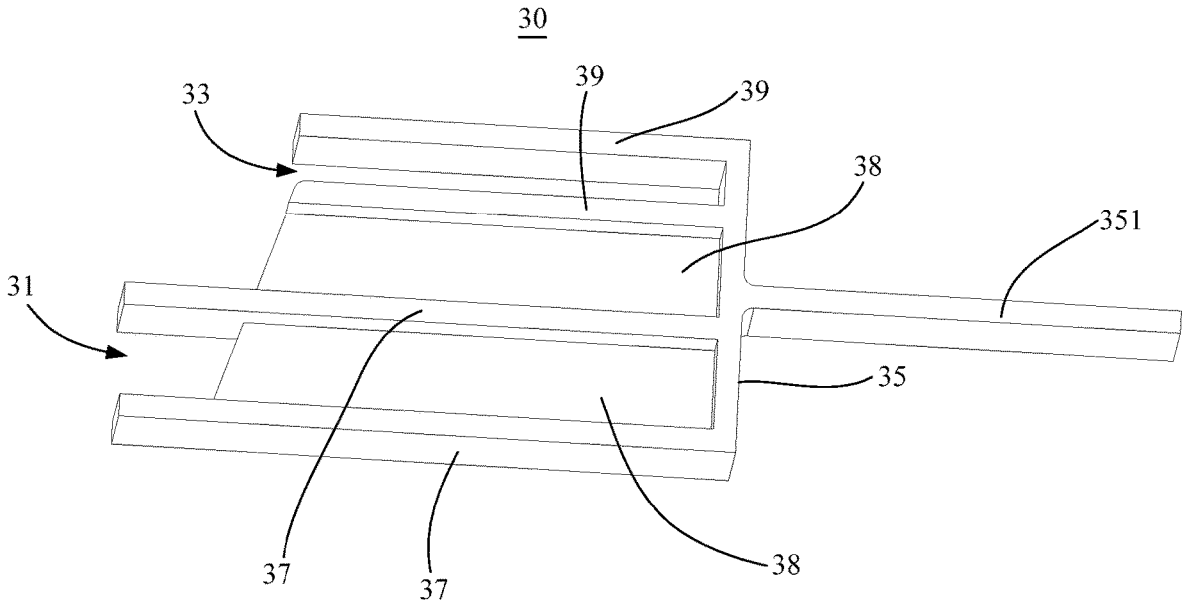
FIG. 7 is a schematic structural diagram of the adjustment member of the blade adjustment mechanism according to an embodiment.

Referring to FIG. 7, in an embodiment of this application, one of the at least two adjustment member 30 includes a main body plate 35 and a plurality of first side plates 37 extending from a surface of the main body plate 35 and a plurality of second side plates 39 extending from a surface of the main body plate 35. The main body plate 35, a part of each first side plate 37 and a part of each second side plate 39 are accommodated in the sliding space 111. Each two first side plates 37 defines one first adjustment slot 31, and each two second side plates 39 defines one second adjustment slot 33. In this embodiment, the adjustment member 30 may be processed by molding. The first adjustment slot 31 may be defined by the first side plates 37, and the second adjustment slot 33 may be defined by the second side plates 39. So that the first wind deflectors 50 and the second wind deflectors 70 may be well driven, and raw materials are saved, which is convenient for users to use. It can be understood that a number of the first adjustment slots 31 and a number of the second adjustment slots 33 correspond to a number of the first wind deflectors 50 and a number of the second wind deflectors, respectively.

Further, one of the at least two adjustment members 30 further includes a reinforcement plate 38 connecting two side plates of one first adjustment slot 31; and/or the reinforcement plate 38 is configured to connect one of the plurality of first side plates 37 and one of the plurality of second side plates 39. The reinforcement plate 38 is provided to increase the strength of the first adjustment slot 31, so that two slot walls of the first adjustment slot 31 may better drive the second rotation and connection shaft 5333, facilitating the opening or gathering of the wind deflectors in the air outlet 211. It can be understood that a reinforcement plate 38 may also be provided in the second adjustment slot 33 to increase the strength of the second adjustment slot 33. Moreover, a reinforcement plate 38 may also be provided between the first side plate 37 and the second side plate 39 to make the strengths of the first adjustment slot 31 and the second adjustment slot 33 higher, increasing the strength of the adjustment member 30, which is convenient for users to use.

Further, the main body plate 35 further includes an operation part 351 on a surface facing away from the plurality of first side plates 37, and the operation part 351 is configured to extend out of the sliding space 111. The first adjustment slot 31 and the second adjustment slot 33 may be moved by driving the operation part 351, to facilitate the user to push the adjustment member 30. It can be understood that an extension direction of the operation part 351 may be set according to actual needs, as long as it is convenient for the user to use.

This application further provides an air circulator 200 including a housing 210, a cross-flow wind wheel 230 and a blade adjustment mechanism 100 located above the cross-flow wind wheel 230. The housing 210 defines an air outlet 211. The cross-flow wind wheel 230 is fixedly connected with the housing 210. The blade adjustment mechanism 100 includes:

a fixing bracket 10, fixedly connected with the housing 210 and defining a sliding space 111;

at least two adjustment members 30, a part of each of the at least two adjustment members 30 being accommodated in the sliding space 111 and being slidably connected with the fixing bracket 10, each of the at least two adjustment members 30 defining a first adjustment slot 31 at an end adjacent to the air outlet 211; and at least two first wind deflectors 50, a part of one of the at least two first wind deflectors 50 being configured to extend into the air outlet 211 and being rotationally connected with the fixing bracket 10, a part of one of the at least two first wind deflectors 50 facing away from the air outlet 211 being movably accommodated in the first adjustment slot 31;

where the at least two adjustment members 30 are driven to move away from or move closer to each other, and the first adjustment slot 31 is configured to drive one of the at least two first wind deflectors 50 to rotate to make the air outlet 211 blow divergently or in a concentrated manner. Since the air circulator 200 adopts 1 the above-mentioned embodiments, it has at least all the beneficial effects brought by the solutions of the above-mentioned embodiments, which will not be repeated here.

It can be understood that the air circulator 200 may be an air conditioner, a tower fan, an air purifier, a humidifier, etc.

What is claimed is:

1. A blade adjustment mechanism, applied to an air circulator comprising a housing defining an air outlet, wherein the blade adjustment mechanism comprises:

a fixing bracket, fixedly connected with the housing and defining a sliding space;

at least two adjustment members, a part of each of the at least two adjustment members being accommodated in the sliding space and being slidably connected with the fixing bracket, each of the at least two adjustment members defining a first adjustment slot at an end adjacent to the air outlet; and at least two first wind deflectors, a part of one of the at least two first wind deflectors being configured to extend into the air outlet and being rotationally connected with the fixing bracket, a part of one of the at least two first wind deflectors facing away from the air outlet being movably accommodated in the first adjustment slot;

wherein the at least two adjustment members are configured to be driven to move away from or move closer to each other, and the first adjustment slot is configured to drive one of the at least two first wind deflectors to rotate to make the air outlet blow divergently or in a concentrated manner.

2. The blade adjustment mechanism according to claim 1, wherein each of the at least two first wind deflectors comprises:

a blade, accommodated in the air outlet; and a rotation and connection adjustment member, a first end of the rotation and connection adjustment member being fixedly connected with the blade, a second end of the rotation and connection adjustment member being rotationally connected with the fixing bracket, a part of the rotation and connection adjustment member being movably accommodated in the first adjustment slot.

3. The blade adjustment mechanism according to claim 1, wherein one of the at least two adjustment members further defines at least one second adjustment slot at a side adjacent to the at least two first wind deflectors;

the blade adjustment mechanism further comprises at least one second wind deflector located between two of the at least two first wind deflectors and rotationally connected with the fixing bracket;

a part of the at least one second wind deflector is configured to extend into the air outlet, a part of one of the at least one second wind deflector facing away from the air outlet being movably accommodated in one of the at least one second adjustment slot, the at least two adjustment members being configured to be driven to move away from or move closer to each other, the at least one second adjustment slot being configured to drive the at least one second wind deflector to rotate to make the air outlet blow divergently or in a concentrated manner.

4. The blade adjustment mechanism according to claim 2, wherein one of an end of the rotation and connection adjustment member facing away from the blade and the fixing bracket defines an insertion hole, the second of the end of the rotation and connection adjustment member facing away from the blade and the fixing bracket comprising an insertion post, the insertion post being inserted into the insertion hole to rotationally connect the rotation and connection adjustment member and the fixing bracket.

5. The blade adjustment mechanism according to claim 4, wherein the rotation and connection adjustment member comprises a first rotation and connection shaft extending from one end of the blade and a first adjustment rod extending from an outer side surface of the first rotation and connection shaft, the insertion hole being defined on the first rotation and connection shaft and extending along an axial direction of the first rotation and connection shaft, a portion of the first adjustment rod facing away from the first rotation and connection shaft being accommodated in the first adjustment slot.

6. The blade adjustment mechanism according to claim 5, wherein the first adjustment rod comprises a first rod and a second rotation and connection shaft, the first end of the first rod being fixedly connected with an outer surface of the first rotation and connection shaft, the second end of the first rod being fixedly connected with an outer surface of the second rotation and connection shaft, the second rotation and connection shaft being accommodated in the first adjustment slot, the outer surface of the second rotation and connection shaft being abutted against a slot wall of the first adjustment slot.

7. The blade adjustment mechanism according to claim 6, wherein one of the at least two adjustment members further defines at least one second adjustment slot at a side adjacent to the at least two first wind deflectors;

the blade adjustment mechanism further comprises at least one second wind deflector located between two of the at least two first wind deflectors and rotationally connected with the fixing bracket;

a part of the at least one second wind deflector is configured to extend into the air outlet, a part of one of the at least one second wind deflector facing away from the air outlet being movably accommodated in one of the at least one second adjustment slot, the at least two adjustment members being configured to be driven to move away from or move closer to each other, the at least one second adjustment slot being configured to drive the at least one second wind deflector to rotate to make the air outlet blow divergently or in a concentrated manner.

8. The blade adjustment mechanism according to claim 7, wherein an extension length of the first adjustment slot is smaller than an extension length of the second adjustment slot; and a length of the part of one of the at least two first wind deflectors extending into the first adjustment slot is smaller than a length of the part of the at least one second wind deflector extending into the second adjustment slot.

9. The blade adjustment mechanism according to claim 8, wherein one of the at least two adjustment members comprises a main body plate and a plurality of first side plates extending from a surface of the main body plate and a plurality of second side plates extending from the surface of the main body plate, the main body plate, a part of each of the plurality of first side plates and a part of each of the plurality of second side plates being accommodated in the sliding space, each two of the plurality of first side plates defining one first adjustment slot, each two of the plurality of second side plates defining one second adjustment slot.

10. The blade adjustment mechanism according to claim 8, wherein the fixing bracket comprises a main frame, a connection part and a mounting part, the connection part being configured to connect the mounting part and the main frame, the insertion post being provided on the mounting part, a main frame body defining the sliding space.

11. The blade adjustment mechanism according to claim 10, wherein one of an inner wall of the sliding space and one of the at least two adjustment members defines a guide slot, the other of the inner wall of the sliding space and the one of the at least two adjustment members comprising a projection adaptively accommodated in the guide slot, the projection being configured to slide in the guide slot and limit a sliding direction of the one of the at least two adjustment members relative to the fixing bracket.

12. The blade adjustment mechanism according to claim 11, wherein the connection part further comprises a protrusion part at an outer side, the protrusion part defining a mounting hole, the blade adjustment mechanism further comprising a connection piece, the connection piece being configured to pass through the mounting hole to fixedly connect the fixing bracket and the housing.

13. The blade adjustment mechanism according to claim 12, wherein one of the at least two adjustment members comprises a main body plate and a plurality of first side plates extending from a surface of the main body plate and a plurality of second side plates extending from the surface of the main body plate, the main body plate, a part of each of the plurality of first side plates and a part of each of the plurality of second side plates being accommodated in the sliding space, each two of the plurality of first side plates defining one first adjustment slot, each two of the plurality of second side plates defining one second adjustment slot.

14. The blade adjustment mechanism according to claim 13, wherein one of the at least two adjustment members further comprises a reinforcement plate connecting two side plates of one first adjustment slot.

15. The blade adjustment mechanism according to claim 14, wherein the reinforcement plate is configured to connect one of the plurality of first side plates and one of the plurality of second side plates.

16. The blade adjustment mechanism according to claim 15, wherein the main body plate further comprises an operation part on a surface facing away from the plurality of first side plates, and the operation part is configured to extend out of the sliding space.

17. An air circulator, comprising a housing, a cross-flow wind wheel and a blade adjustment mechanism located above the cross-flow wind wheel, the cross-flow wind wheel being fixedly connected with the housing, the housing defining an air outlet, wherein the blade adjustment mechanism comprises:

a fixing bracket, fixedly connected with the housing and defining a sliding space;

at least two adjustment members, a part of each of the at least two adjustment members being accommodated in the sliding space and being slidably connected with the fixing bracket, each of the at least two adjustment members defining a first adjustment slot at an end adjacent to the air outlet; and at least two first wind deflectors, a part of one of the at least two first wind deflectors being configured to extend into the air outlet and being rotationally connected with the fixing bracket, a part of one of the at least two first wind deflectors facing away from the air outlet being movably accommodated in the first adjustment slot;

wherein the at least two adjustment members are driven to move away from or move closer to each other, the first adjustment slot being configured to drive one of the at least two first wind deflectors to rotate to make the air outlet blow divergently or in a concentrated manner.

18. The air circulator according to claim 17, wherein the fixing bracket and the housing are integrally formed; or, the fixing bracket and the housing are detachably provided.

19. The air circulator according to claim 17, wherein each of the at least two first wind deflectors comprises:

a blade, accommodated in the air outlet; and a rotation and connection adjustment member, a first end of the rotation and connection adjustment member being fixedly connected with the blade, a second end of the rotation and connection adjustment member being rotationally connected with the fixing bracket, a part of the rotation and connection adjustment member being movably accommodated in the first adjustment slot.

20. The air circulator according to claim 17, wherein one of the at least two adjustment members further defines at least one second adjustment slot at a side adjacent to the at least two first wind deflectors;

the blade adjustment mechanism further comprises at least one second wind deflector located between two of the at least two first wind deflectors and rotationally connected with the fixing bracket;

a part of the at least one second wind deflector is configured to extend into the air outlet, a part of one of the at least one second wind deflector facing away from the air outlet being movably accommodated in one of the at least one second adjustment slot, the at least two adjustment members being driven to move away from or move closer to each other, the at least one second adjustment slot being configured to drive the at least one second wind deflector to rotate to make the air outlet blow divergently or in a concentrated manner.

* * * * *